US006726608B1

(12) United States Patent
Hsu

(10) Patent No.: US 6,726,608 B1
(45) Date of Patent: Apr. 27, 2004

(54) SWINGABLE EXERCISING DEVICE

(76) Inventor: Chang Chun Hsu, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 10/338,537

(22) Filed: Jan. 9, 2003

(51) Int. Cl.[7] ..... A63B 21/04
(52) U.S. Cl. ..... 482/130; 482/142; 482/121
(58) Field of Search ..... 482/130, 142, 482/129, 93, 94, 96, 148; 297/337, 353

(56) References Cited

U.S. PATENT DOCUMENTS 5,810,751 A * 9/1998 Meier et al. ..... 601/24
5,967,610 A * 10/1999 Lin ..... 297/340
6,146,317 A * 11/2000 Prusick ..... 482/130
6,248,047 B1 * 6/2001 Abdo ..... 482/130
6,312,366 B1 * 11/2001 Prusick ..... 482/130
6,485,398 B1 * 11/2002 Kreft ..... 482/94

* cited by examiner

*Primary Examiner*—Jerome W. Donnelly

(57) ABSTRACT

A swingable exercising device has a base flatly arranged on the ground and a support rod extending from the base. A chair is placed atop the supporting rod. A swingable means is formed by a main arm, an auxiliary arm, a handle, and at least one bearing. The main arm having a first connecting portion exactly covers the supporting rod. The second connecting portion of the main arm is extended from an upper side of the first connecting portion. One end of the auxiliary arm is engaged with the second connecting portion. The handle is engaged to another end of the auxiliary arm. The handle has a C shape and two ends of the handle have respective handle rods. When a force is applied to the swingable means, the swingable means will shift to one side so that one seat on the chair can swing with the swingable means.

4 Claims, 5 Drawing Sheets

SWINGABLE EXERCISING DEVICE

FIELD OF THE INVENTION

The present invention relates to exercising device, and particularly to a swingable exercising device.

BACKGROUND OF THE INVENTION

In general, the massage chair with massage function has only the function of stimulating the muscles of backs of the users, but it can not effectively stimulate or massage the acupuncture points of the body. This is because the acupuncture points for controlling the nerves are concentrated along the backbone so that the massage chair can not deeply massage the acupuncture points. Besides, in general, the massage chair is driven by a motor. This will increase the manufacturing and assemble cost and moreover, it must be used near a power source for getting power to actuate the motor. However, this is inconvenient to users.

SUMMARY OF THE INVENTION

Accordingly, the primary object of the present invention is to provide a swingable exercising device comprising the following components. A base is flatly arranged on the ground; a support rod is mounted upon and extends from the base. A chair is placed on a top of the supporting rod. A swingable means is formed by a main arm, an auxiliary arm, a handle, and at least one bearing. The main arm has a first connecting portion which is positioned at one end with respect to the chair, and exactly covers the supporting rod. The second connecting portion of the main arm is extended from an upper side of the first connecting portion. One end of the auxiliary arm is engaged with the second connecting portion. The handle is engaged to another end of the auxiliary arm. The handle has a C shape and two ends of the handle have respective handle rods for supporting a hand of a user. When a force is applied to the swingable means, the swingable means will shift to one side so that one seat on the chair can swing with the swingable means.

The various objects and advantages of the present invention will be more readily understood from the following detailed description when read in conjunction with the appended drawing.

DETAILED DESCRIPTION OF THE PREFERRED EMBODIMENTS

Figure 1:
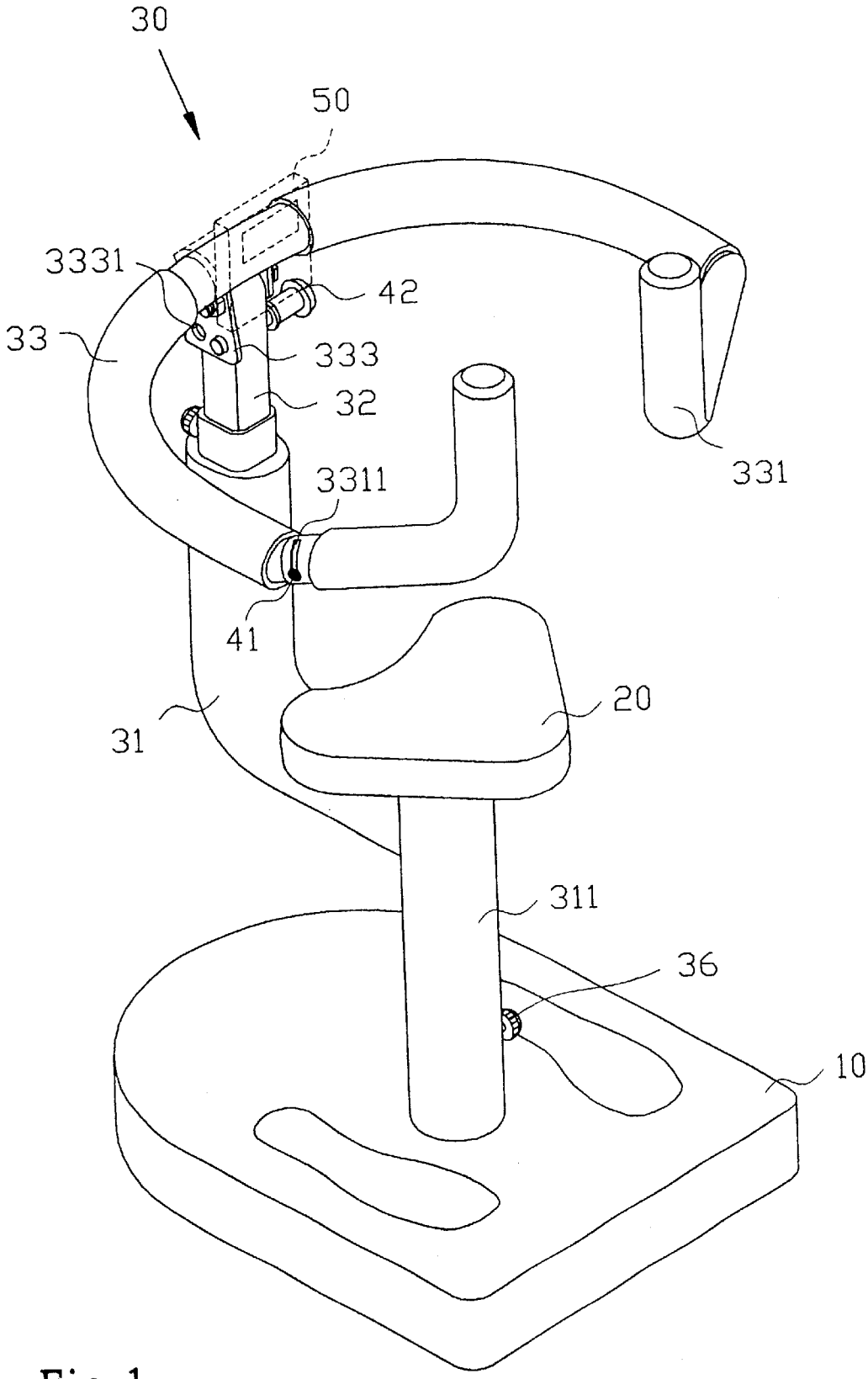
FIG. 1 is an assembled perspective view of the present invention.
Figure 2:
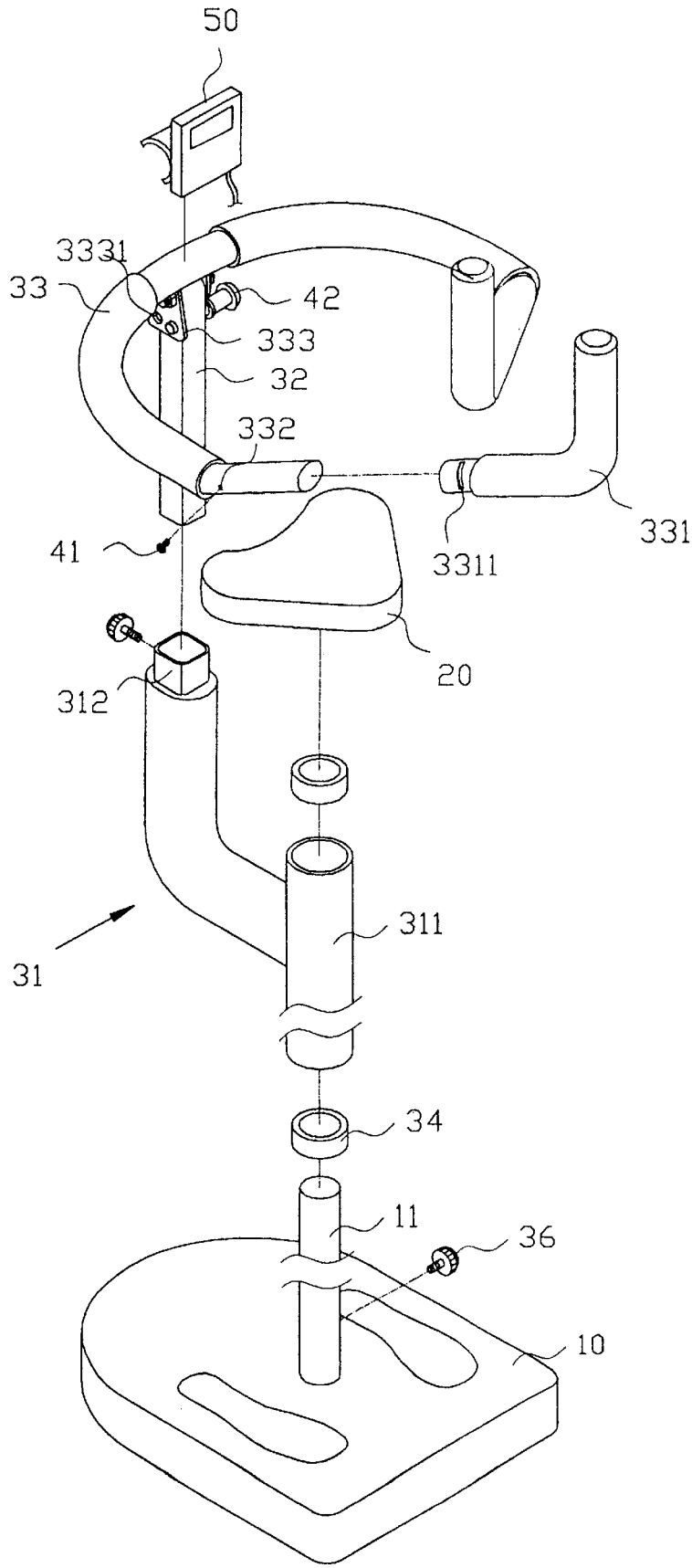
FIG. 2 is an exploded perspective view of the present invention.
Figure 3:
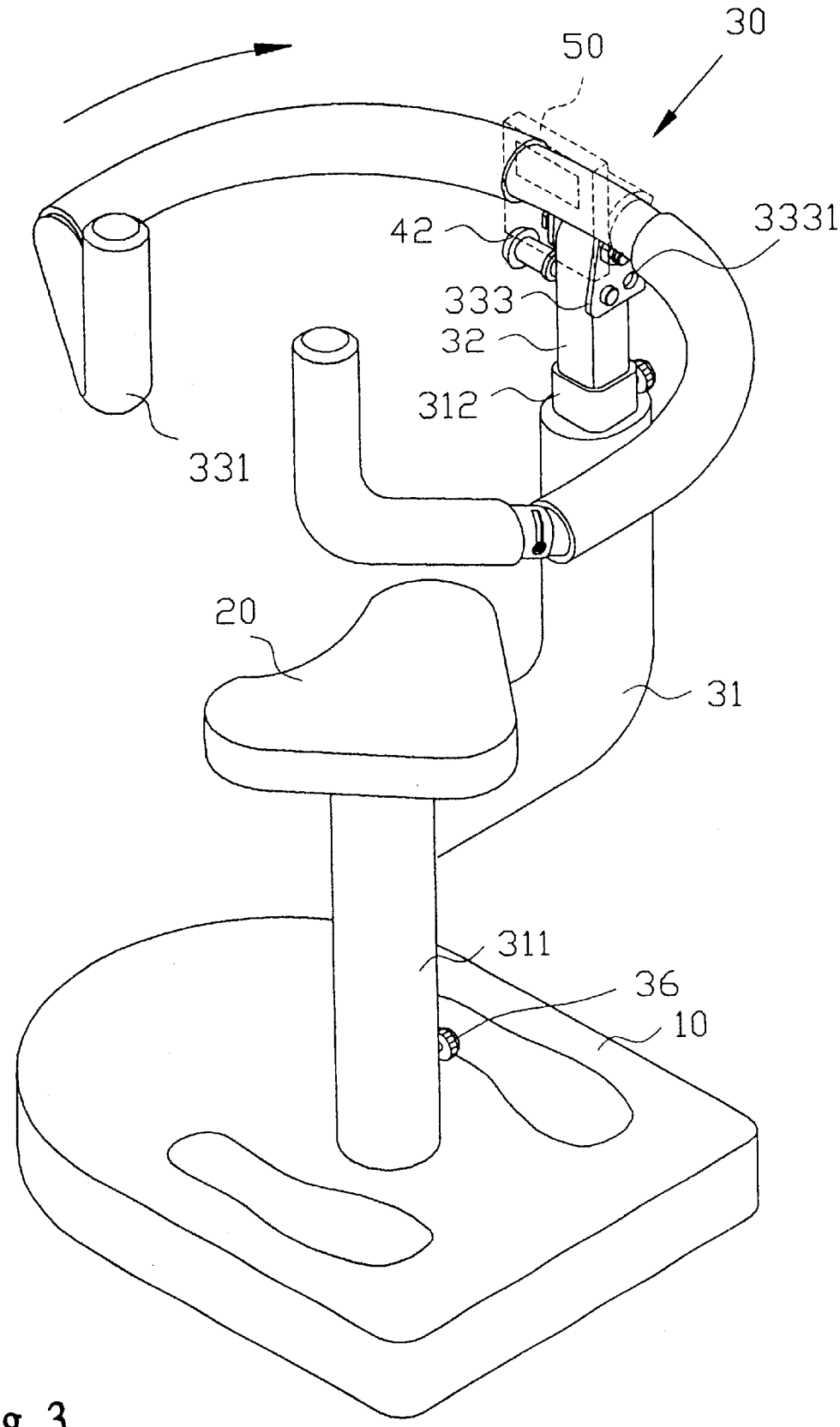
FIG. 3 is a schematic view showing the swinging operation of the present invention.
Figure 4:
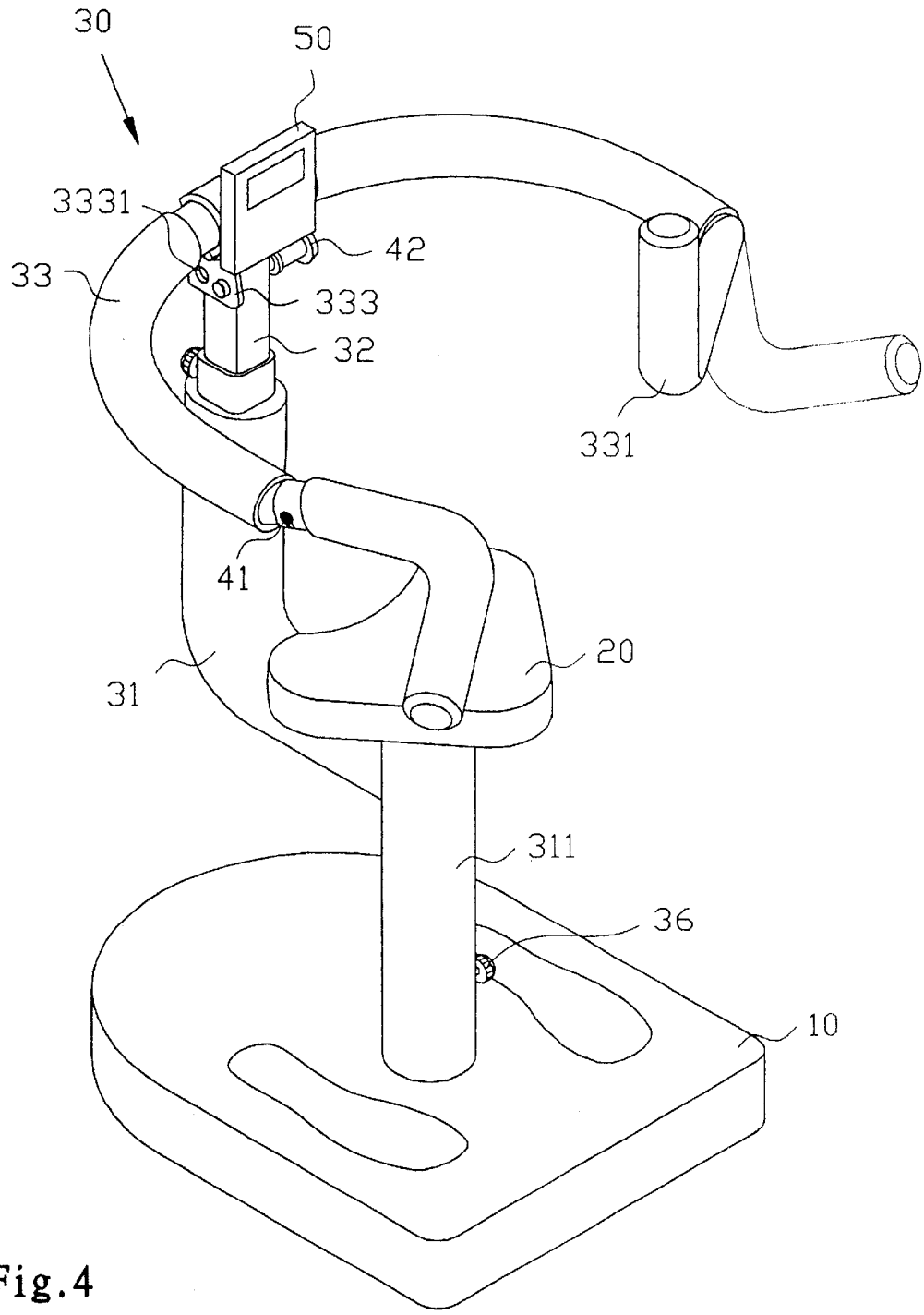
FIG. 4 is a schematic view showing that the orientation of the present invention is adjustable.
Figure 5:
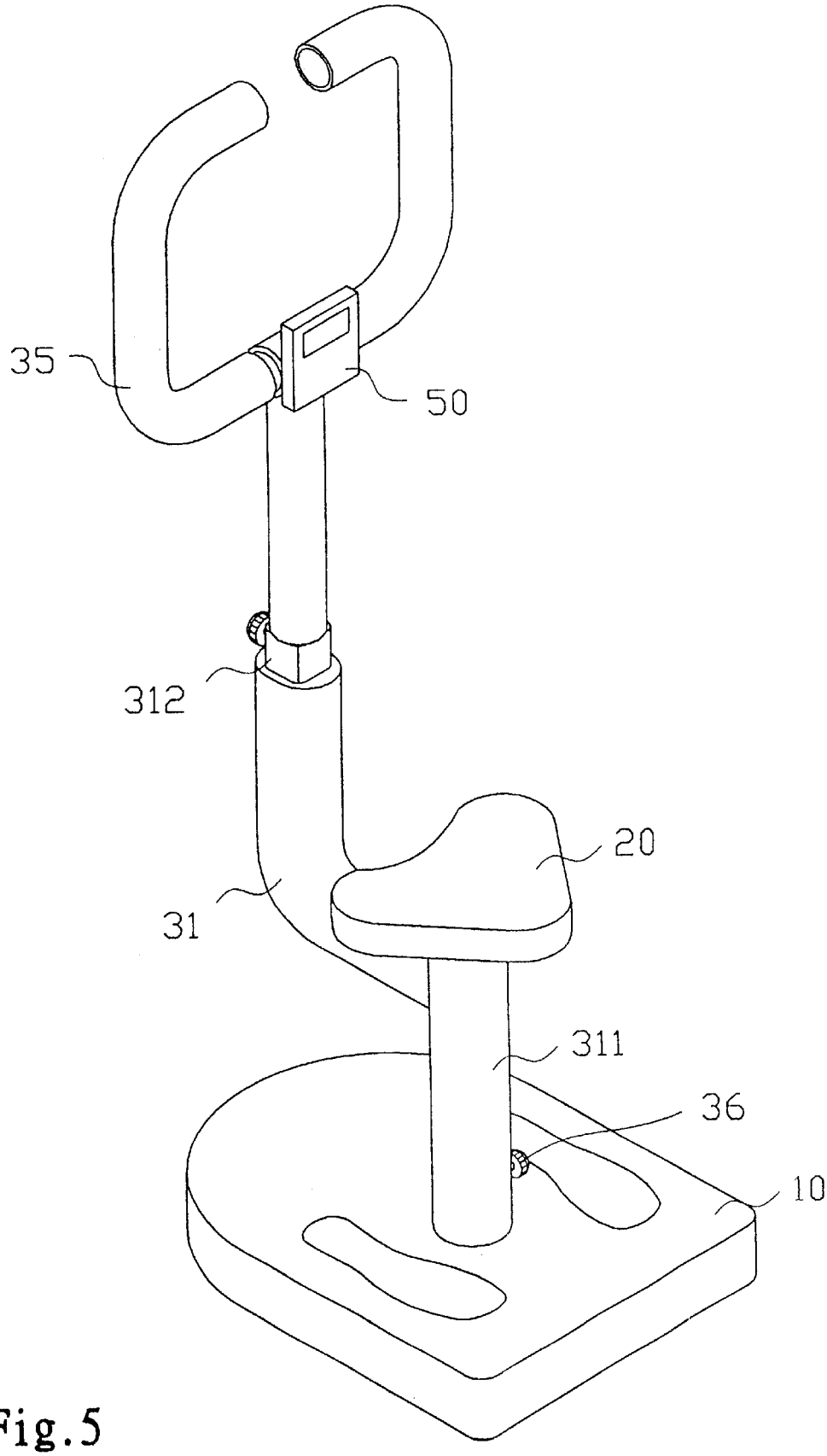
FIG. 5 shows one embodiment of embodiment.

Referring to FIGS. 1 to 4, the swingable exercising device of the present invention is illustrated. The swingable exercising device includes a supporting rod 11, a chair 20, and a swingable means 30.

The base 20 is a flat plate arranged on the ground. A support rod is mounted and extends from the base 20 for installing the chair 20 and the swingable means 30.

The chair 20 is placed on a top of the supporting rod 11.

The swingable means 30 is formed by a main arm 31, an auxiliary arm 32, a handle 33, and two bearings 34. The main arm 31 has a shape like "4" (a Chinese word, spoken as "ji"). The main arm 31 has a first connecting portion 311 and a second connecting portion 312. The first connecting portion 311 is positioned at one end with respect to the chair 20, and exactly covers the supporting rod 11. The two bearings 34 are installed between the supporting rod 11 and the first connecting portion 311. The second connecting portion 312 is extended from an upper side of the first connecting portion 311 so that one end of the auxiliary arm 32 is engaged with the second connecting portion 312. Another end of the auxiliary arm 32 is engaged with the handle 33. A pin 36 serves to fix the first connecting portion 311 of the main arm 31 to the supporting rod 11.

The handle 33 has a shape like "C". Two ends of the handle 33 have respective L-shape handle rods 331 for placing handles of users. The two L shape handle rods 331 are assembled to the handle 33. In assembly, each of one ends of the hand rods 331 has a trench 3311. Each end of the handle 33 has a screw hole 332 at position with respect to the trench 3311 of handle rod 331. A screw rod 41 passes through the trench 3311 and then is locked to the screw hole 332. Thereby, the two handle rods can shift through an angle as forces are applied thereto. This provides a convenient operation to the user.

Furthermore, the handle 33 of the present invention is assembled to the auxiliary arm 32. A handle 33 of the present invention is assembled to the auxiliary arm 32. Two pivotal pieces 333 of different lengths are protruded from the handle 33. A lower end of the longer pivotal piece 333 is formed with at least two pivotal holes 3331 for positioning a positioning pin 42. The positioning pin 42 is inserted into one of the pivotal hole 3331 so that the tilted angle of the handle 33 is adjustable.

Moreover, on the swingable means 30 of the present invention, a counter 50 (or timer) is installed for counting the times of the swinging operation of the swingable means 30 (or determining the time period of the swinging). The counter 50 is pivotally engaged to the handle 33 so that the orientation thereof can be adjusted conveniently.

By above components, when a user seat on the chair 20, the swingable means 30 can be pushed by swinging the waist of the user. It should by noted that the pin 36 between the first connecting portion 311 and the supporting rod 11 serves to position the main arm 31 so that the main arm 31 is fixed. Thereby, when not using the present invention, the user can make warming-up exercise by resisting against the handle 33.

Finally, it should be noted that by the structure of the present invention, the waist of the user can swing sufficient since when the user swings his (or her) upper half, the nerves and acupuncture points can be stimulated sufficiently. If the user swings his (or her) upper half, the nerves and acupuncture points on the back and backbone of the user will be stimulated. This is useful to the paraplegia patient.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A swingable exercising device comprising a base capable of being flatly arranged on the ground;

a support rod mounted on and extending upwards from the base;

a chair installed on a top of the supporting rod;

a swingable means comprising:

a main arm having a first connecting portion and a second connecting portion; the first connecting portion exactly enclosing an outer surface of the supporting rod; at least one bearings being installed between the supporting rod and the first connecting portion; the second connecting portion extending from a lateral side of the first connecting portion;

an auxiliary arm having one end engaged with the second connecting portion;

a handle engaged to another end of the auxiliary arm; the handle having a C shape and two ends of the handle extending with respective handle rods for supporting hands of a user;

each hand rod has one end having a trench; one distal end of each handle having a screw hole positioned with respect to the trench of the handle rod; each trench being passed through by a screw rod and then the screw rod being locked to a respect one of the screw holes; thereby, the two handle rods being rotatable through an angle as forces are applied thereto;

wherein when a force is applied to the swingable means, the swingable means will shift to one side so that one seat on the chair can swing with the swingable means.

2. The swingable exercising device as claimed in claim 1, wherein an orientation of the auxiliary arm with respective to the handle adjustable.

3. The swingable exercising device as claimed in claim 1, wherein a pin serves to fix the first connecting portion of the main arm to the supporting rod.

4. The swingable exercising device as claimed in claim 1, further comprising a stand rod, when the C shape handle is withdrawn, the stand rod is placed at a position for installing handle so that the user can hold the handle for exercising.

* * * * *